US005693917A

United States Patent [19]

Bertagni et al.

[11] Patent Number: 5,693,917

[45] Date of Patent: Dec. 2, 1997

[54] PLANAR DIAPHRAGM LOUDSPEAKER

[75] Inventors: Alejandro J. Bertagni, Lake Forest; Eduardo J. Bertagni, Tustin; James Schuessler; Alfredo D. Ferrin, both of Newport Beach, all of Calif.

[73] Assignee: Sound Advance Systems, Inc., Santa Ana, Calif.

[21] Appl. No.: 610,974

[22] Filed: Mar. 1, 1996

Related U.S. Application Data

[63] Continuation of Ser. No. 153,925, Nov. 18, 1993, abandoned.

[51] Int. Cl.[6] ..... G10K 13/00

[52] U.S. Cl. ..... 181/173; 181/174; 381/203

[58] Field of Search ..... 181/163, 164, 181/165, 166, 173, 174; 381/192, 202, 203, 205

[56] References Cited

U.S. PATENT DOCUMENTS

| | | | |
|---|---|---|---|
| 3,596,733 | 8/1971 | Bertagni . | |
| 3,722,617 | 3/1973 | Bertagni . | |
| 3,767,005 | 10/1973 | Bertagni . | |
| 3,779,336 | 12/1973 | Bertagni . | |
| 3,792,394 | 2/1974 | Bertagni . | |
| 3,801,943 | 4/1974 | Bertagni . | |
| 4,003,449 | 1/1977 | Bertagni . | |
| 4,184,563 | 1/1980 | Bertagni . | |
| 4,257,325 | 3/1981 | Bertagni . | |
| 4,328,400 | 5/1982 | Shimada et al. | 381/203 |
| 4,820,077 | 4/1989 | Sawada et al. | 40/402 |
| 4,928,312 | 5/1990 | Hill | 381/192 |
| 4,997,058 | 3/1991 | Bertagni . | |
| 5,007,707 | 4/1991 | Bertagni . | |
| 5,283,836 | 2/1994 | Trufitt | 381/203 X |
| 5,425,107 | 6/1995 | Bertagni | 381/202 |

*Primary Examiner*—Khanh Dang

*Attorney, Agent, or Firm*—Sheppard, Mullin, Richter & Hampton LLP

[57] ABSTRACT

A planar diaphragm loudspeaker incorporating a planar diaphragm having multiple sound producing regions, a support frame, and one or more electromagnetic drivers coupled to the sound producing regions on the rear surface of the diaphragm. A first sound producing region is formed generally centrally on the rear surface of the diaphragm, and second and third sound producing regions are formed on opposite sides thereof. The sound producing regions comprise raised portions on the rear surface of the diaphragm which are symmetrical about both first and second orthogonal axes for balance. Cross members extend between opposite sides of the support frame so as to overlay all of the sound producing regions to selectively mount separate electromagnetic drivers for coupling to each sound producing region, as well as to mount one or more anchors extending from the cross members to the perimeters of the second and third sound producing regions in order to isolate them from the first sound producing region. The support frame is constructed from hollow rectangular channel frame members which are joined together by L-shaped corner connectors.

37 Claims, 3 Drawing Sheets

PLANAR DIAPHRAGM LOUDSPEAKER

This application is a continuation of application Ser. No. 08/153,925, filed Nov. 18, 1993, now abandoned.

BACKGROUND OF THE INVENTION

The present invention relates generally to loudspeakers and, more particularly, to improvements in planar-type loudspeakers utilizing a substantially flat diaphragm.

In recent years, certain advances in dynamic loudspeaker design have been provided by the advent of planar diaphragm loudspeakers. Such loudspeakers utilize a relatively stiff and substantially planar (or flat) diaphragm. The diaphragm is supported by a frame, and a voice coil assembly or electromagnetic driver is mounted for coupling to the rear surface of the diaphragm. The voice coil or driver acts like a piston, pressing on the diaphragm and causing it to vibrate sufficiently to produce sound. Examples of such planar diaphragms are shown and described in U.S. Pat. Nos. 4,003,449 and 4,997,058, both issued in the name of Jose J. Bertagni.

Typically, a planar diaphragm is constructed of a pre-expanded cellular plastic material, such as polystyrene or styrofoam. The advantages provided by planar diaphragm loudspeakers over loudspeakers utilizing conventional cone-type diaphragms include greater dispersion of sound and economy of manufacture. Moreover, the front surface of a planar diaphragm can be molded to take on the appearance of an acoustic tile, permitting unobtrusive installation of the loudspeaker in ceilings of commercial structures formed of like-appearing acoustic tiles. Alternatively, the diaphragm's front surface can be molded smooth and flat for installation as a seamless part of a plasterboard wall or ceiling, as shown and described in co-pending application Ser. No. 866,067, entitled Planar-type Loudspeaker With Dual Density Diaphragm, filed Apr. 9, 1992 in the name of Alejandro J. Bertagni et al., and assigned to the same assignee as the present application. A number of such diaphragms also can be joined together in a contiguous and seamless array to create a sound screen upon which video images can be projected, as shown and described in U.S. Pat. No. 5,007,707, issued in the name of Jose J. Bertagni.

Ideally, a loudspeaker exhibits a substantially flat or level response characteristic over the frequency range of sounds that it is designed to reproduce, and it reproduces those sounds with relative efficiency. The efficiency of a loudspeaker can be measured by the loudness of sound produced relative to the electrical energy provided as an electric current through the voice coil.

The frequency response and efficiency of a planar diaphragm are determined in large part by the type and density of its material, and the area, thickness and contour of its sound producing region. Generally, the reproduction of low frequency sound (i.e., 60 to 500 Hz.) calls for a diaphragm having a larger sound producing area made from a lower density material with a thickness and contour allowing greater flexibility, as compared to a diaphragm designed for the reproduction of high frequency sound (i.e., 500 to 20,000 Hz.). The practical design of any particular diaphragm, however, reflects compromises between these competing criteria. Moreover, practical design considerations often result in asymmetries and imbalances in the diaphragm, necessitating selective insertion of weights in recesses formed in the rear surface of the diaphragm to help shape its frequency response characteristic.

For increased efficiency and sound fidelity with planar diaphragm loudspeakers, it has been known to define different frequency sections or regions in the rear surface of the diaphragm having prescribed areas, thicknesses and contours. Each region of the diaphragm can be coupled to a different voice coil to reproduce a specific range of sound frequencies. For example, one region and voice coil combination can be designed to reproduce low frequencies, while another region and voice coil combination can be designed to reproduce high frequencies. The different frequency sections of the diaphragm can be isolated from one another by a rigid frame member in contact with the diaphragm between adjacent sound producing regions.

Although these existing planar diaphragm loudspeaker designs have been generally satisfactory, it is desirable to make more efficient use of the available sound producing area of the diaphragm for improved frequency response, particularly at low frequencies. At the same time, it is always desired to have simpler designs which are easier and less expensive to manufacture. The present invention fulfills these needs.

SUMMARY OF THE INVENTION

Briefly, and in general terms, the present invention resides in an improved planar diaphragm loudspeaker in which different sound producing regions in the rear surface of the diaphragm are configured and arranged to provide greater effective area for the low frequency region and an enhanced low frequency response characteristic. Moreover, the different sound producing regions are arranged in a more efficient and balanced manner to reduce the number of components utilized in the loudspeaker assembly. The present invention also provides a simplified and improved design for the supporting frame for the diaphragm.

More specifically, and by way of example only, a planar diaphragm loudspeaker in accordance with the present invention incorporates a planar diaphragm, a support frame, and one or more electromagnetic drivers coupled to the sound producing regions on the rear surface of the diaphragm to cause the front surface of the diaphragm to vibrate and reproduce sound in response to an electrical signal. A first sound producing region is formed generally centrally on the rear surface of the diaphragm, and second and third sound producing regions are formed on opposite sides of the first sound producing region, separated from the first sound producing region by one or more channels formed in the diaphragm. The first sound producing region is configured to produce low frequency sound, and the second and third sound producing regions are configured to produce mid and high frequency sounds, respectively.

The first sound producing region extends substantially from one edge of the diaphragm to an opposite edge along a first axis. The second and third sound producing regions are each disposed on a second axis orthogonal to the first axis, along portions of the opposing edges of the diaphragm. As a result, all but a relatively small portion of the diaphragm is devoted to the first sound producing region for enhanced reproduction of low frequency sound. In addition, to further enhance its low frequency response, the diaphragm can combine two separate diaphragm members, a first diaphragm member having the three sound producing regions formed on its rear surface as just described, and a second diaphragm member, in the form of a coupling disc, interposed between the first sound producing region and its electromagnetic driver. By making the second diaphragm member out of material of greater density than the first diaphragm member, the low frequency response of the first sound producing region can be extended for improved performance.

The sound producing regions comprise raised portions on the rear surface of the diaphragm which are symmetrical about both the first and second orthogonal axes. In particular, the first sound producing region is itself symmetrical about both axes; the second and third sound producing regions are each individually symmetrical about the second axis and are symmetrical with each other about the first axis. As a result of these symmetries, the present invention has reduced need for insertion of weights to correct imbalances in the loudspeaker.

In the preferred embodiment, the diaphragm is rectangularly-shaped. The first sound producing region comprises a central portion characterized by a generally four-sided contour with two opposing sides having a convex shape and the other two opposing sides having a concave shape. The first sound producing region further includes raised block portions at opposite ends of the convex-shaped side of the central portion. The second and third sound producing regions are disposed opposite the concave-shaped sides of the central portion and have a generally trapezoidal shape. An endless channel encircles the central portion of the first sound producing region, separating it from both the block portions and the second and third sound producing regions, to allow the central portion to flex in response to the vibrations of the electromagnetic driver. Because the central portion inherently tends to have more flexibility along the first axis due to its longer length in this direction, additional channels are formed along the first axis and on opposite sides of the central portion, generally parallel to the second and third sound producing regions, to compensate by giving the central portion increased flexibility along the second axis.

In a further aspect of the invention, one or more cross members extend between opposite sides of the support frame, such that the cross members are spaced above the diaphragm and overlay all of the sound producing regions. As a result, the cross members are capable of mounting a separate electromagnetic driver for coupling to each sound producing region. These same cross members also serve to mount one or more anchors extending from the cross members to the perimeters of the second and third sound producing regions in order to isolate them from the first sound producing region. The anchors can be mechanically fastened to the cross members and affixed by adhesion to the diaphragm. In the preferred embodiment, the anchors comprise screws which are threaded to the cross members at one end and embedded in epoxy resin in recesses formed in the diaphragm at the other end.

In another aspect of the present invention, a simplified frame structure is provided in which a plurality of elongated frame members, in the form of generally hollow, closed rectangular channels, are joined together by L-shaped corner connectors to make a rectangular support frame. Each corner connector has a leg that is sized for insertion into a frame member with an interference fit. In the preferred embodiment, the connector legs have serrations on their outside surfaces, and the frame members have ribs formed on their inside surfaces to grip each other for a secure connection. An open channel is formed along one side of the frame members and provides an upper support surface to which the cross member can be fastened.

From the foregoing, it will be appreciated that planar diaphragm loudspeakers in accordance with the invention provide an improved frequency response, particularly in the low frequency range, in a design that utilizes fewer components and, therefore, is simpler and more economical to manufacture. Other features and advantages of the present invention should be apparent from the following description of the preferred embodiment, taken in conjunction with the accompanying drawings, which illustrate, by further way of example, the principles of the invention.

DESCRIPTION OF THE PREFERRED EMBODIMENT

Figure 1:
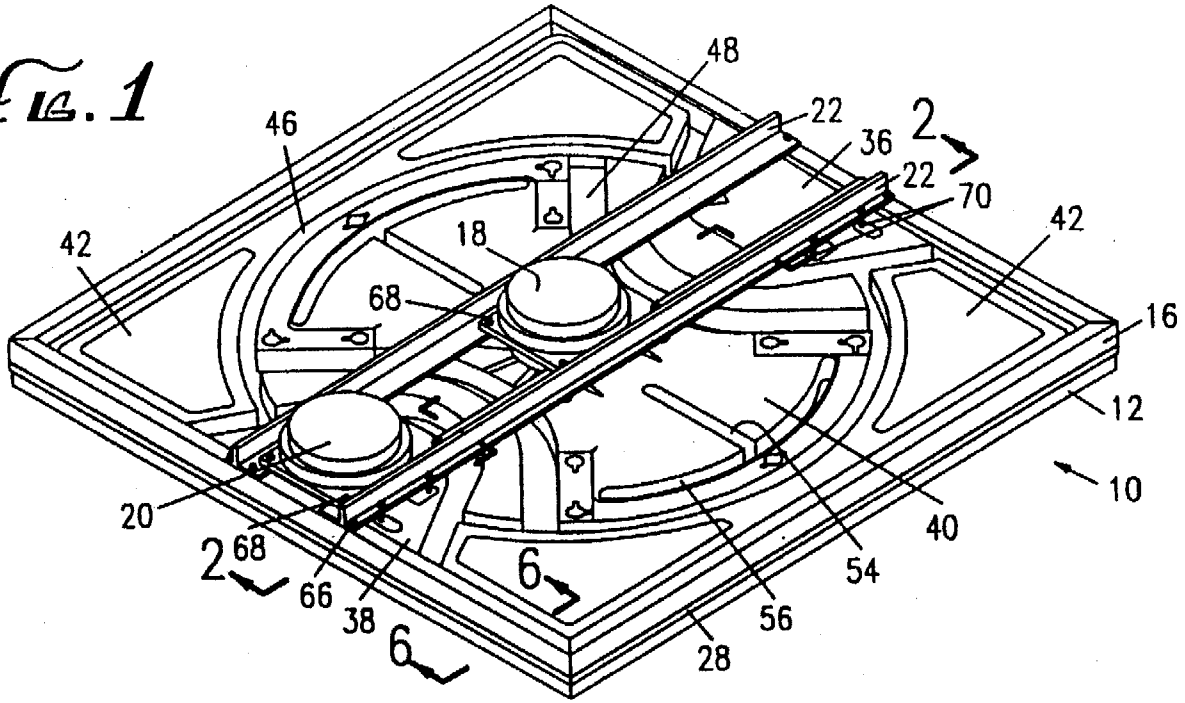
FIG. 1 is a perspective view of an improved planar diaphragm loudspeaker in accordance with the present invention.
Figure 2:
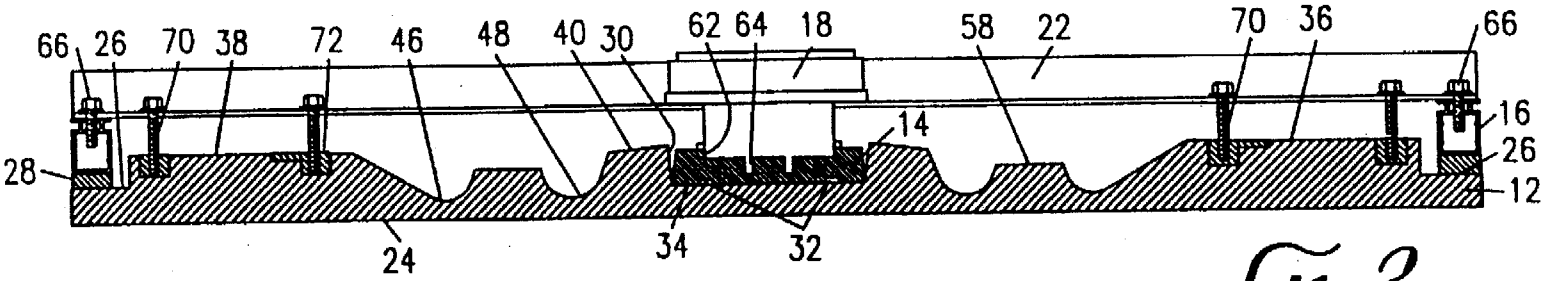
FIG. 2 is an enlarged cross-sectional view taken along the line 2—2 through the planar diaphragm loudspeaker illustrated, in FIG. 1.

Referring now to the drawings, and particularly to FIGS. 1 and 2 thereof, there is shown a planar diaphragm loudspeaker, indicated generally by reference numeral 10, including a planar diaphragm comprising first and second diaphragm members 12 and 14, respectively, supported by a frame structure 16. In the configuration illustrated, first and second voice coil assemblies 18 and 20, respectively, are mounted on cross members 22 and coupled by adhesives to the diaphragm as described in more detail below. The loudspeaker 10 is designed to be used with or without an enclosure or baffle (not shown).

As best shown in FIG. 2, the first and second diaphragm members 12 and 14, respectively, are both generally flat. The first diaphragm member 12 is square in shape and its face surface 24 is exposed in use for the reproduction of sound. The rear surface 26 of the first diaphragm member 12 is mounted around its perimeter to the frame 16 by a dampening material 28, comprising a strip of foam rubber, disposed between the frame 16 and the rear surface 26 of the first diaphragm member 12. The second diaphragm member 14 is circular in shape and is received within a circular recess 30 formed in the center of the first diaphragm member 12 and held in place by adhesive. This circular recess 30 has four centering pins 32 which align with a complementary centering groove formed in the front surface 34 of the second diaphragm member 14.

The first diaphragm member 12 has three sound producing regions formed on its rear surface 26. The second sound producing region 36 is for reproduction of mid frequency sound from about 400 to 5,000 Hz. The third sound producing region 38 is for reproduction of high frequency sound from about 3,000 to 20,000 Hz. They are disposed on opposite sides of the first diaphragm member 12. The first sound producing region is for reproduction of low frequency sound from below 20 Hz. to about 1,000 Hz. and comprises substantially the remainder of the first diaphragm member 12, including a central portion 40 disposed between a pair of block portions 42. These ranges will vary with different electromagnetic drivers, diaphragm materials and densities, adhesives, and so forth.

Figures 3, 4:
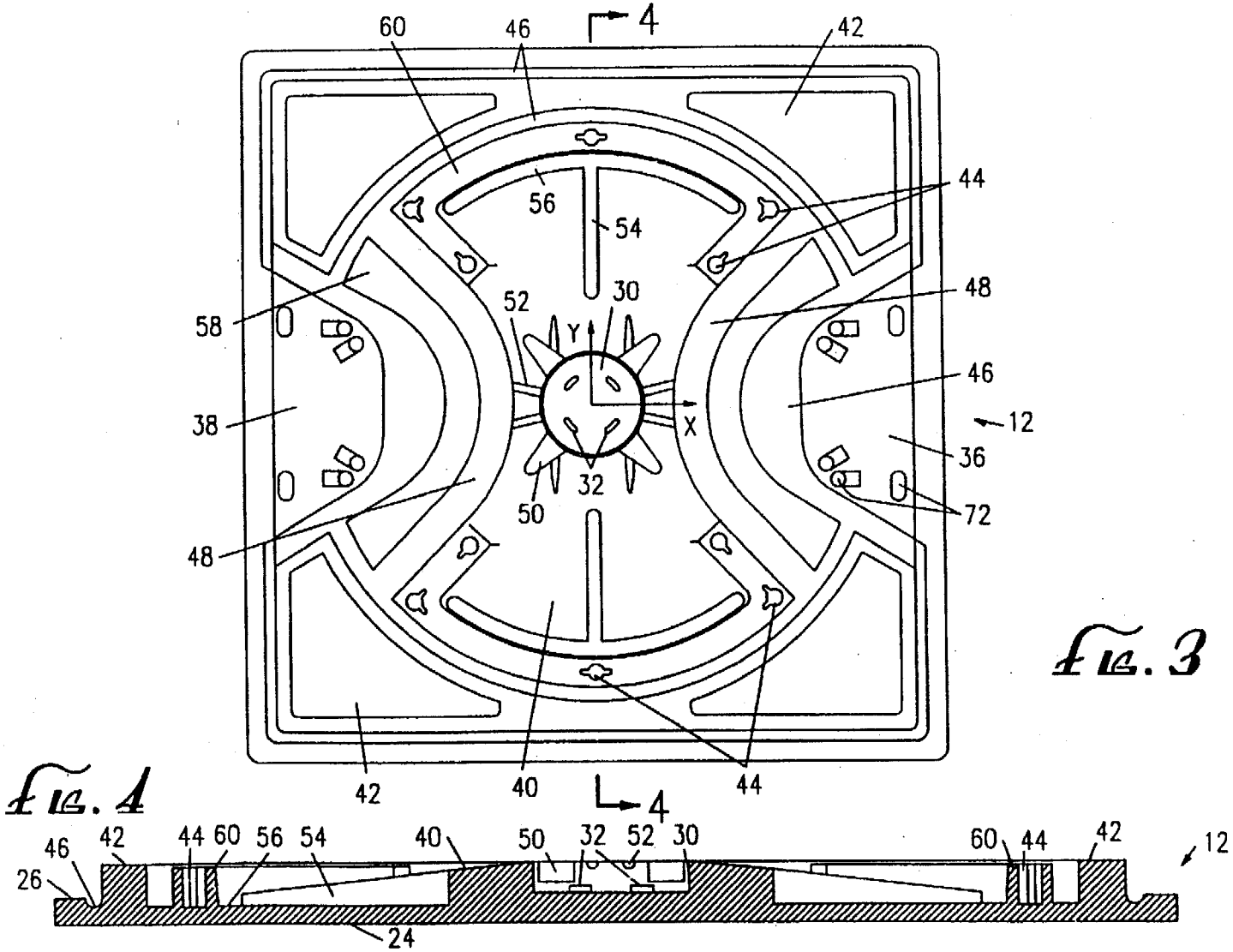
FIG. 3 is a plan view of the rear face of the planar diaphragm shown removed from the loudspeaker illustrated in FIG. 1.
FIG. 4 is an enlarged cross-sectional view taken along the line 4—4 through the planar diaphragm illustrated in FIG. 1.

Referring to FIG. 3, it can be seen that the first sound producing region is symmetrical about two orthogonal axes (designated the x-axis and the y-axis) that extend through the center of the first diaphragm member 12 parallel to its edges. It can also be seen that the second sound producing region 36 is symmetrical with the third sound producing region 38 about the y-axis, and that the second and third sound producing regions are each individually symmetrical about the x-axis, i.e., the axis on which they are disposed. These symmetries are important because they reduce the need to insert weights (not shown) in recesses 44 formed in the rear surface 26 of the first diaphragm member 12, to correct imbalances in the diaphragm.

The central portion 40 of the first sound producing region is generally circular-shaped except where it is interrupted on opposite sides by the second and third sound producing regions 36 and 38, respectively. The resulting shape of the central portion 40 is that of a four-sided contour, with its two opposite sides on the y-axis having a convex curvature and its two opposite sides on the x-axis having a concave curvature. The second and third sound producing regions 36 and 38 are generally trapezoidal in shape and are disposed on the x-axis, essentially in the voids created by the concave sides of the central portion 36. The block portions 42 are disposed on the y-axis, beyond the convex sides of the central portion 40, and have a complementary shape that essentially fills up the rectangular outline of the first diaphragm member 12 on those sides of the diaphragm.

An endless channel 46 encircles the central portion 40 of the first sound producing region, separating it from both the block portions 42 and the second and third sound producing regions 36 and 38, respectively, to allow the central portion to adequately vibrate in response to the first electromagnetic driver 18. The channel 46 also continues around the perimeters of the block portions 42 so that they also can contribute to the reproduction of low frequency sound by vibrating in response to the first driver 18.

For linearity of vibrational movement, it has been found desirable for the central portion 40 of the first sound producing region to have a similar degree of flexibility along both of its axes. Because the central portion 40 has a greater length along the y-axis, it inherently tends to have greater flexibility in that direction. To compensate and provide greater flexibility along the x-axis, a second, arcuate channel 48 is formed in the rear surface 26 on each side of the y-axis, between the central portion 40 and the second and third sound producing regions 36 and 38.

To further enhance the low frequency response of the first sound producing region, the central portion 40 has a gentle dome shape (FIG. 4), with a variety of grooves 50 and 52 and channels 54 and 56 formed therein in both the radial and circumferential directions for improved linearity of movement during operation. Opposing pairs of stiffening ribs 58 and 60 across the x-axis and the y-axis, respectively, have been found to also enhance the low frequency response.

Both the first and second diaphragm members 12 and 14 are molded from polystyrene. As previously noted, and as indicated by the cross-hatching in FIG. 2, the first diaphragm member 12 has a lower density than the density of the second diaphragm member 14. The different densities of the diaphragm members are selected so that the first diaphragm member 12 has optimal flexibility in the first sound producing region to move back and forth in response to the lowest frequency vibrations of the first electromagnetic driver 18. As the first diaphragm member loses efficiency in the first sound producing region with increasing frequency, sound energy from the first driver is principally reproduced by the higher density second diaphragm member 14. Thus, specific frequencies of sound are generated by the structure that will most efficiently reproduce them. In the embodiment shown, the density of the first diaphragm member 12 is about 1.7 $lbs/ft^3$, and the density of the second diaphragm member 14 is about 3.0 $lbs/ft^3$.

The second diaphragm member 14 is adhered within the circular recess 30 by epoxy cement. A difference between the height of the four centering pins 32 and the depth of the complementary centering groove leaves a constant gap to accommodate a uniform thickness of adhesive, thus giving a more constant performance of the loudspeaker 10 and making better usage of the adhesive. A circular recess 62 is formed in the rear surface of the second diaphragm member 14, in turn, for coupling to the first electromagnetic driver 18. A heat insulating disk (not shown) is sandwiched between the driver 18 and the second diaphragm member 14, and the insulating disk is joined to the second diaphragm member by epoxy cement with a similar arrangement to that between the first and second diaphragm members to ensure a uniform thickness of adhesive.

Although epoxy cement is used to adhere the diaphragm members together and to the insulating disk, another adhesive can be used provided that it contains no solvent to attack the polystyrene material, forms a reliable bond, and cures to a very hard state. In contrast, it is has been found preferable to use a soft, resilient adhesive to couple the first (or low frequency) electromagnetic driver 18 to the first sound producing region, a relatively soft epoxy to couple a mid frequency driver (not shown) to the second sound producing region 36, and a hard epoxy to couple the second (or high frequency) driver 20 to the third sound producing region 38.

The cross members 22 are mounted by screws 66 on the frame 20. The cross members 22 are spaced above and extend centrally across all of the sound producing regions of the diaphragm. Each cross member 22 comprises an inverted T-shaped structure. The cross members 22 serve to mount the drivers 18 and 20, also by screws 68. The cross members 22 also can serve to mount terminals, crossovers, cable terminators, transformers, cable strain reliefs, and so forth (not shown). In accordance with the invention, it will be appreciated that because the three sound producing regions are aligned, the pair of cross members 22 can serve to mount all of the drivers. In the configuration shown in FIG. 1, only two drivers are shown mounted for the first (or low frequency) sound producing region and the third (or high frequency) sound producing region, respectively; the second (or mid frequency) sound producing region is shown vacant. However, for manufacturing efficiency, any combination of drivers could be utilized without modifying the cross members.

In planar diaphragm loudspeakers with diaphragms having different sound producing regions, it is desirable to mechanically isolate one region from the other regions so that the operation of any individual electromagnetic driver does not interfere with the operation of another driver. In previous loudspeakers, this has been accomplished by utilizing an additional cross member, mounted so as to be in contact with the diaphragm between the different sound producing regions. The present invention eliminates need for such an additional member by providing anchors 70 between the cross members 22 and the perimeters of the second and third sound producing regions 36 and 38, respectively. These anchors 70 are in the form of screws which thread into the cross members 22 and extend into recesses 72 formed in the rear surface 26 of the first diaphragm member 12. The ends of the screws are adhered to the diaphragm by filling the recesses 72 with epoxy resin. The anchors 70 thus serve to substantially prevent vibrations in the first sound producing region from travelling to the second or third sound producing region.

Figure 5:
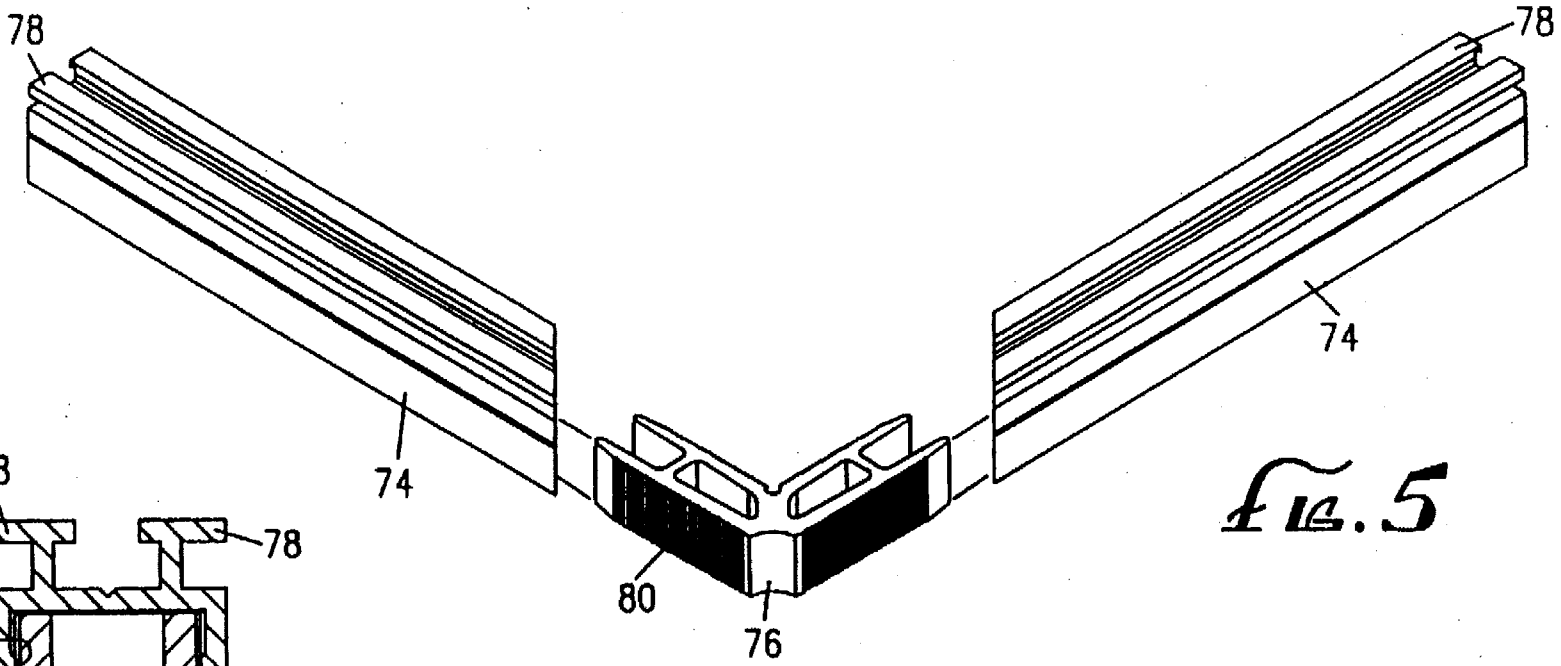
FIG. 5 is an exploded perspective view of a connector for joining a pair of frame members together at a corner of the frame for the planar diaphragm loudspeaker.
Figure 6:
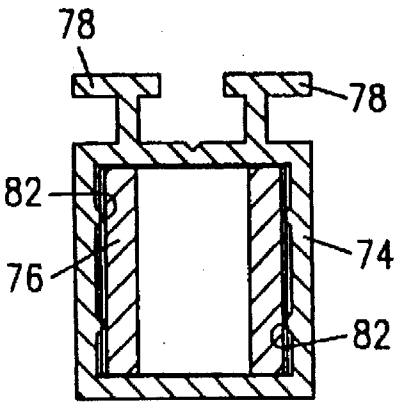
FIG. 6 is an enlarged cross-sectional view taken along the line 6—6 through the frame portion of the planar diaphragm loudspeaker illustrated in FIG. 1.

Turning now to FIGS. 5 and 6, the supporting frame structure 16 is formed by four frame members 74 which are joined together by L-shaped corner connectors 76 to make a rectangular frame. Each frame member 74 is in the form of a hollow, closed rectangular channel with an open channel defined by a pair of upstanding T-shaped members 78 extending along one exterior side. Each open channel provides an upper support surface upon which the cross members 22 are mounted. These channels are also designed to receive the heads of bolts or screws for securing the loudspeaker 10 within cabinets or in modular multi-speaker arrangements, or for securing accessories to the loudspeaker.

Each leg of the corner connectors 76 is shaped and sized for insertion into the frame members 74 with an interference fit. To ensure that the corner connectors 76 and frame members 74 fasten together securely, the legs of the corner connectors have serrations 80 formed along opposing outer surfaces, and the frame members have longitudinally-directed ribs 82 formed along corresponding inner surfaces. The serrations 80 on the legs of the corner connectors 76 grip the ribs 82 in the frame members 74 for a secure connection. Both the frame members 74 and the corner connectors 76 are preferably formed as an extrusion out of aluminum material.

The present invention has been described above in terms of a presently preferred embodiment so that an understanding of the present invention can be conveyed. There are, however, other configurations for planar diaphragm loudspeakers not specifically described herein for which the present invention is applicable. The present invention should therefore not be seen as limited to the particular embodiments described above. All modifications, variations, or equivalent arrangements that are within the scope of the attached claims should therefore be considered to be within the scope of the invention.

We claim:

1. A planar diaphragm loudspeaker comprising:

a planar diaphragm including a front surface and a rear surface, the rear surface having a first sound producing region formed generally centrally thereon and further having second and third sound producing regions formed on opposite sides of the first sound producing region along a straight line that passes through each of the three sound producing regions, wherein the first sound producing region is arranged to reproduce low frequency sound, the second sound producing region is arranged to reproduce mid-frequency sound, and the third sound producing region is arranged to reproduce high frequency sound;

a support frame for supporting the planar diaphragm; and a first electromagnetic driver coupled to at least one of the sound producing regions on the rear surface of the diaphragm such that the driver will cause the front surface of the diaphragm to vibrate and reproduce sound in response to an electrical signal.

2. A loudspeaker as defined in claim 1, wherein the first sound producing region includes a raised pattern that is symmetrical about first and second orthogonal axes.

3. A loudspeaker as defined in claim 2, wherein the first sound producing region extends substantially from one edge of the diaphragm to an opposite edge of the diaphragm along the first axis, and further wherein the second and third sound producing regions are each disposed on the second axis.

4. A loudspeaker as defined in claim 3, wherein the second and third sound producing regions are each symmetrical about the second axis.

5. A loudspeaker as defined in claim 3, wherein the second sound producing region is symmetrical with the third sound producing region about the first axis.

6. A planar diaphragm loudspeaker as set forth in claim 1, wherein each of the second and third sound producing regions comprises a raised portion of the diaphragm and is separated from the first sound producing region by a channel formed in the diaphragm.

7. A planar diaphragm loudspeaker as set forth in claim 1, and further including a cross member extending between opposite sides of the support frame and overlying all of the sound producing regions, wherein the cross member is arranged to mount the first electromagnetic driver for coupling to the first sound producing region and to mount a second electromagnetic driver for coupling to the second sound producing region.

8. A planar diaphragm loudspeaker as set forth in claim 7, wherein the cross member is spaced from the rear surface of the diaphragm, and further including one or more anchors extending between the cross member and at least one of the sound producing regions to isolate that sound producing region from the other sound producing regions.

9. A loudspeaker as defined in claim 1, wherein the low frequency sound reproduced by the first sound producing region covers a frequency range from below 20 Hz to about 1,000 Hz, the mid-frequency sound reproduced by the second sound producing region covers a frequency range from about 400 to 5,000 Hz, and the high frequency sound reproduced by the third sound producing region covers a frequency range from about 3,000 to 20,000 Hz.

10. A planar diaphragm loudspeaker as set forth in claim 1, and further including:

a cross member extending between opposite sides of the support frame and overlying all of the sound producing regions; and second and third electromagnetic drivers, wherein the cross member is arranged to mount the first electromagnetic driver for coupling to the first sound producing region, the second electromagnetic driver for coupling to the second sound producing region, and the third electromagnetic driver for coupling to the third sound producing region.

11. A planar diaphragm loudspeaker as set forth in claim 1, and further including a cross member extending between opposite sides of the support frame and overlying all of the sound producing regions, wherein the cross member is arranged to mount the first electromagnetic driver for coupling to the first sound producing region and to mount a second electromagnetic driver for coupling to the third sound producing region.

12. A planar diaphragm loudspeaker as set forth in claim 1, wherein the first sound producing region of the rear surface has a raised contour that is symmetrical about first and second orthogonal axes and that forms a gentle dome shape for enhancing the low frequency response of the first sound producing region.

13. A planar diaphragm loudspeaker comprising:

a substantially planar diaphragm constructed from a first diaphragm member and a second diaphragm member each having a front surface and a rear surface, the rear surface of the first diaphragm member having a first sound producing region formed generally centrally thereon and second and third sound producing regions formed on opposite sides of the first sound producing region, each of the sound producing regions arranged to produce a particular frequency range of sound, and the front surface of the second diaphragm member joined to the rear surface of the first diaphragm member in the first sound producing region;

a support frame for supporting the planar diaphragm; and an electromagnetic driver coupled to the rear surface of the second diaphragm member such that the driver will cause both diaphragm members in at least the first sound producing region to vibrate and reproduce sound in response to an electrical signal.

14. A loudspeaker as defined in claim 13, wherein the density of the second diaphragm member is greater than the density of the first diaphragm member.

15. A planar diaphragm loudspeaker as set forth in claim 13, wherein the second and third sound producing regions comprise raised portions that occupy only a portion of the opposite sides of the rear surface of the planar diaphragm, and further wherein the second and third sound producing regions are each separated from the first sound producing region by a channel formed in the diaphragm.

16. A planar diaphragm loudspeaker as set forth in claim 13, and further including a cross member extending between opposite sides of the support frame and overlying all of the sound producing regions, wherein the cross member is arranged to mount a separate electromagnetic driver for coupling to the second sound producing region.

17. A planar diaphragm loudspeaker as set forth in claim 16, wherein the cross member is spaced from the rear surface of the first diaphragm member, and further including one or more anchors extending between the cross member and the second and third sound producing regions to isolate them from the first sound producing region.

18. A planar diaphragm loudspeaker comprising:

a generally rectangularly-shaped planar diaphragm including a front surface and a rear surface, the rear surface defining a first sound producing region formed generally centrally thereon to produce sound in a low frequency range, the first sound producing region disposed symmetrically about first and second orthogonal axes, and the rear surface further including second and third sound producing regions formed along opposite sides thereof to produce sound in mid-frequency and high frequency ranges, respectively, the second sound producing region disposed symmetrically with the third sound producing region about the first axis;

a support frame for supporting the planar diaphragm; and a first electromagnetic driver coupled to at least one of the sound producing regions on the rear surface of the diaphragm such that the driver will cause the front surface of the diaphragm to vibrate and reproduce sound in response to an electrical signal.

19. A planar diaphragm loudspeaker as set forth in claim 18, wherein the second and third sound producing regions are each symmetrical about the second axis, and further wherein the second and third sound producing regions occupy only a portion of the opposite sides of the rear surface of the planar diaphragm, the substantial remainder of the rear surface comprising the first sound producing region.

20. A planar diaphragm loudspeaker as set forth in claim 18, wherein each of the second and third sound producing regions is separated from the first sound producing region by a channel formed in the diaphragm.

21. A planar diaphragm loudspeaker as set forth in claim 18, and further including a cross member extending between opposite sides of the support frame and overlying all of the sound producing regions, wherein the cross member is arranged to mount the first electromagnetic driver four coupling to the first sound producing region and to mount a second electromagnetic driver for coupling to one of the second or third sound producing regions.

22. A planar diaphragm loudspeaker as set forth in claim 21, wherein the cross member is spaced from the rear surface of the diaphragm, and further including one or more anchors extending between the cross member and the second and third sound producing regions to isolate them from the first sound producing region.

23. A planar diaphragm loudspeaker comprising:

a planar diaphragm including a front surface and a rear surface, the rear surface having first, second, and third sound producing regions formed thereon, each of the sound producing regions arranged to produce a particular frequency range of sound, the first sound producing region disposed centrally on the rear surface of the diaphragm, the first sound producing region including a generally four-sided raised contour having two opposing sides with a convex shape and two opposing sides with a concave shape, and the second and third sound producing regions disposed adjacent the opposing concave sides of the first sound producing region, each of the second and third sound producing regions having a generally trapezoidal shape;

a support frame for supporting the planar diaphragm; and an electromagnetic driver coupled to at least one of the sound producing regions on the rear surface of the diaphragm such that the driver will cause the front surface of the diaphragm to vibrate and reproduce sound in response to an electrical signal.

24. A planar diaphragm loudspeaker as set forth in claim 23, and further including a channel encircling the first sound producing region, the channel separating the second and third sound producing regions from the first sound producing region.

25. A planar diaphragm loudspeaker as set forth in claim 24, wherein the first sound producing region includes a second channel positioned between the opposing concave sides of the first sound producing region and the second and third sound producing regions.

26. A planar diaphragm loudspeaker as set forth in claim 24, wherein the first sound producing region includes a raised stiffening rib positioned between the opposing concave sides of the first sound producing region and the second and third sound producing regions.

27. A planar diaphragm loudspeaker as set forth in claim 24, and further including a raised stiffening rib formed along the opposing convex sides of the first sound producing region.

28. A planar diaphragm loudspeaker as set forth in claim 23, wherein the first sound producing region further includes raised block portions on each side of said second and third sound producing regions.

29. A planar diaphragm loudspeaker as set forth in claim 23, wherein the raised contour of the first sound producing region forms a gentle dome shape that enhances the low frequency response of the first sound producing region.

30. In a planar diaphragm loudspeaker including a substantially planar diaphragm having at least first and second sound producing regions formed thereon, each of the sound producing regions arranged to produce a particular frequency range of sound, and a support frame for supporting the planar diaphragm, the improvement comprising:

a cross member extending between opposite sides of the support frame, the cross member spaced from the diaphragm; and a plurality of discrete anchors spaced apart from one another along the cross member, each anchor extending between the cross member and the diaphragm to isolate the first sound producing region from the second sound producing region.

31. A planar diaphragm loudspeaker as set forth in claim 30, wherein the cross member overlies both the first and the second sound producing regions and is arranged to mount a separate electromagnetic driver for coupling to each sound producing region.

32. A planar diaphragm loudspeaker as set forth in claim 31, wherein the planar diaphragm further includes a third sound producing region formed thereon, and the cross member overlies the first, second, and third sound producing regions and is arranged to mount a separate electromagnetic driver for coupling to each sound producing region.

33. In a planar diaphragm loudspeaker including a substantially planar diaphragm having at least first and second sound producing regions formed thereon, each of the sound producing regions arranged to produce a particular frequency range of sound, and a support frame for supporting the planar diaphragm, the improvement comprising:

a cross member extending between opposite sides of the support frame, the cross member spaced from the diaphragm; and one or more anchors extending between the cross member and the diaphragm, the anchors having a first end affixed to the cross member and a second end affixed to the diaphragm, whereby the first sound producing region is isolated from the second sound producing region.

34. A planar diaphragm loudspeaker as set forth in claim 33, wherein the anchors are affixed mechanically to the cross member.

35. A planar diaphragm loudspeaker as set forth in claim 33, wherein the one or more anchors are affixed by adhesion to the diaphragm.

36. A planar diaphragm loudspeaker as set forth in claim 34, wherein the anchors comprise screws.

37. A planar diaphragm loudspeaker as set forth in claim 35, wherein the second ends of the anchors are embedded in resin in recesses formed in the diaphragm.

* * * * *